US007530325B2

(12) United States Patent
Swenson et al.

(10) Patent No.: US 7,530,325 B2
(45) Date of Patent: May 12, 2009

(54) HALYARD SYSTEM FOR A FLAG POLE

(75) Inventors: Paul Swenson, Sandy, UT (US); Mark Dickey, Sandy, UT (US); Jack Van Schelt, Bountiful, UT (US)

(73) Assignee: Colonial Discount Flag & Flagpole Co., Sandy, UT (US)

( * ) Notice: Subject to any disclaimer, the term of this patent is extended or adjusted under 35 U.S.C. 154(b) by 152 days.

(21) Appl. No.: 10/562,190

(22) PCT Filed: Jun. 21, 2004

(86) PCT No.: PCT/US2004/020076

§ 371 (c)(1),
(2), (4) Date: Sep. 11, 2006

(87) PCT Pub. No.: WO2004/113649

PCT Pub. Date: Dec. 29, 2004

(65) Prior Publication Data

US 2007/0006794 A1 Jan. 11, 2007

Related U.S. Application Data

(60) Provisional application No. 60/480,272, filed on Jun. 20, 2003.

(51) Int. Cl.
*G09F 17/00* (2006.01)

(52) U.S. Cl. ..... 116/173; 24/130; 52/40; 52/651.01

(58) Field of Classification Search ..... 116/173–175, 116/28 R, 209; 40/218, 602, 591, 607.01; 248/511, 219.1, 59–62; 70/18, 58; D8/356; 24/130; 52/40, 651.01, 834, 843–844
See application file for complete search history.

(56) References Cited

U.S. PATENT DOCUMENTS 269,399 A * 12/1882 Ensign ..... 24/130
876,770 A * 1/1908 Brundell ..... 24/132 R
1,298,550 A 3/1919 Newell (Continued)

FOREIGN PATENT DOCUMENTS

JP 2003036043 A * 2/2003

(Continued)

*Primary Examiner*—R. A. Smith
*Assistant Examiner*—Tania C Courson
(74) *Attorney, Agent, or Firm*—Thorpe North & Western LLP

(57) ABSTRACT

A method and apparatus for providing a halyard system configured to suspend a flag to a flag pole. The halyard system includes a holding member, a line member and a weighted-down mass structure. The holding member is coupled to the flag pole. The line member is operatively coupled to an upper side portion of the flag and extends through an upper portion of the flag pole to be removably coupled to the holding member. The weighted-down mass structure is operatively coupled to a lower side portion of the flag and operable to freely hang from the lower side portion of the flag. With this arrangement, the weighted-down mass structure is operable to place tension on the line member and a peripheral side of the flag so as to substantially maintain the peripheral side of the flag in a suspended position along side the flag pole.

24 Claims, 5 Drawing Sheets

U.S. PATENT DOCUMENTS

| | | | | | |
|---|---|---|---|---|---|
| 1,338,210 | A | | 4/1920 | Buckley | |
| 1,528,747 | A | * | 3/1925 | Allen | 24/133 |
| 1,631,567 | A | * | 6/1927 | Walton | 116/173 |
| 1,987,281 | A | | 1/1935 | Briggs | |
| 2,296,082 | A | * | 9/1942 | Bierk | 24/130 |
| 2,377,219 | A | | 5/1945 | Ellis | |
| 3,398,714 | A | * | 8/1968 | Axel et al. | 114/218 |
| 3,976,283 | A | | 8/1976 | Schmit | |
| 4,281,439 | A | * | 8/1981 | Klein | 24/130 |
| 4,515,241 | A | | 5/1985 | Gebelius | |
| 4,791,878 | A | | 12/1988 | Lewis | |
| 4,889,321 | A | | 12/1989 | Burns | |
| 5,096,022 | A | | 3/1992 | Bowers | |
| 5,113,776 | A | * | 5/1992 | Knecht | 114/102.1 |
| 5,168,828 | A | | 12/1992 | Smyly, Sr. | |
| 5,335,621 | A | | 8/1994 | Willis et al. | |
| 5,373,287 | A | | 12/1994 | Doublet | |
| 5,454,202 | A | | 10/1995 | Van Der Weijden | |
| 5,495,821 | A | | 3/1996 | Brewer | |
| 5,671,509 | A | * | 9/1997 | Yeung | 24/130 |
| 5,809,930 | A | | 9/1998 | Brooks | |
| 5,983,825 | A | | 11/1999 | Nowak et al. | |
| 6,155,018 | A | | 12/2000 | Yang | |
| 7,451,720 | B2 | * | 11/2008 | Somers | 116/173 |
| 2003/0193804 | A1 | | 10/2003 | Schroeder | |

FOREIGN PATENT DOCUMENTS

| | | |
|---|---|---|
| WO | WO 87/00953 | 2/1987 |

* cited by examiner

HALYARD SYSTEM FOR A FLAG POLE

The present application is a US national stage filing under 35 USC 371 and claims priority from PCT application No. PCT/US04/20076 filed on Jun. 21, 2004, which claims benefit of U.S. application Ser. No. 60/480,272 filed on Jun. 20, 2003.

BACKGROUND OF THE INVENTION

1. Field of the Invention

The present invention relates generally to flag poles. More particularly, the present invention relates to a simplified halyard system for a flag coupled to a flag pole.

2. Related Art

Halyard systems for hoisting and lowering flags to flag poles are well known in the art. Flag poles extending upward 20 ft. and taller typically include halyard systems having various pulleys at the upper and/or lower ends of the flag pole with a flag line coupled to such pulleys and attached to a peripheral side of the flag. Halyard systems utilizing pulleys are known to be located internal and external to the flag pole with various manually accessible locking mechanisms for holding the flag in a suspended position with respect to the flag pole. However, external pulley systems pose problems with theft and exposure to the elements in the environment. Although internal pulley systems deter theft and exposure to the elements, such internal pulley systems are typically much more expensive than the external systems as the internal systems often require more advanced pulley systems to suspend the flag along the outside of the pole.

The locking mechanisms for maintaining and manually releasing the flag in the suspended position with respect to the flag pole are also known in the art. One locking mechanism includes a crank coupled to a line member with a locking wench system. The crank can be turned to facilitate up and down movement of the line member and can be locked in position with the wench system to thereby position the flag along the flag pole as desired. However, this locking mechanism is expensive and requires excessive components along with the pulley system to properly function.

Another type of locking mechanism operated with a pulley system is a spring-biasing cam locking system. Such a spring-biasing cam locking system prevents movement of the line in the upward direction and allows movement of the line in the downward direction. When the line needs to be moved in the upward direction, the line can be pulled downward and moved to an open space adjacent to the cam to allow such movement in the upward direction. Although the spring-biasing cam locking mechanism is relatively inexpensive, over time the line will experience wear against the ruff surface of the cam and components of the spring-biasing cam locking mechanism may break down and degrade. Further, the spring-biasing cam locking mechanism is operated with a pulley system, which adds cost to the manufacturer and the end user.

Another problem with internal pulley systems is the necessity of having an access opening with a locking door to allow both authorized access and prevent unauthorized access to the halyard system. Such locking doors typically include a hinge, various plates for mounting the door to the cylindrical surface of the tube, several exposed fasteners and a pad lock. These many components employed for the locking door will often weather over time from exposure to the elements and are rather unsightly to look upon.

SUMMARY OF THE INVENTION

It has been recognized that it would be advantageous to develop a simplified halyard system for suspending a peripheral side of a flag adjacent to a flag pole that is less costly for the manufacturer and the end user.

The present invention relates to a method and apparatus for providing a halyard system configured to suspend a flag on a flag pole. The halyard system includes a holding member, a line member and a weighted-down mass structure. The holding member is coupled to the flag pole. The line member is operatively coupled to an upper side portion of the flag and extends through an upper portion of the flag pole and is operable to be removably coupled to the holding member. The weighted-down mass structure is operatively coupled to a lower corner of the flag adjacent the pole and is operable to freely hang from the lower side portion of the flag. With this arrangement, the weighted-down mass structure places tension on the line member and a peripheral side of the flag so as to substantially maintain the peripheral side of the flag in a suspended position along side the flag pole.

Additional features and advantages of the invention will be apparent from the detailed description which follows, taken in conjunction with the accompanying drawings, which together illustrate, by way of example, features of the invention.

DETAILED DESCRIPTION

Figure 1:
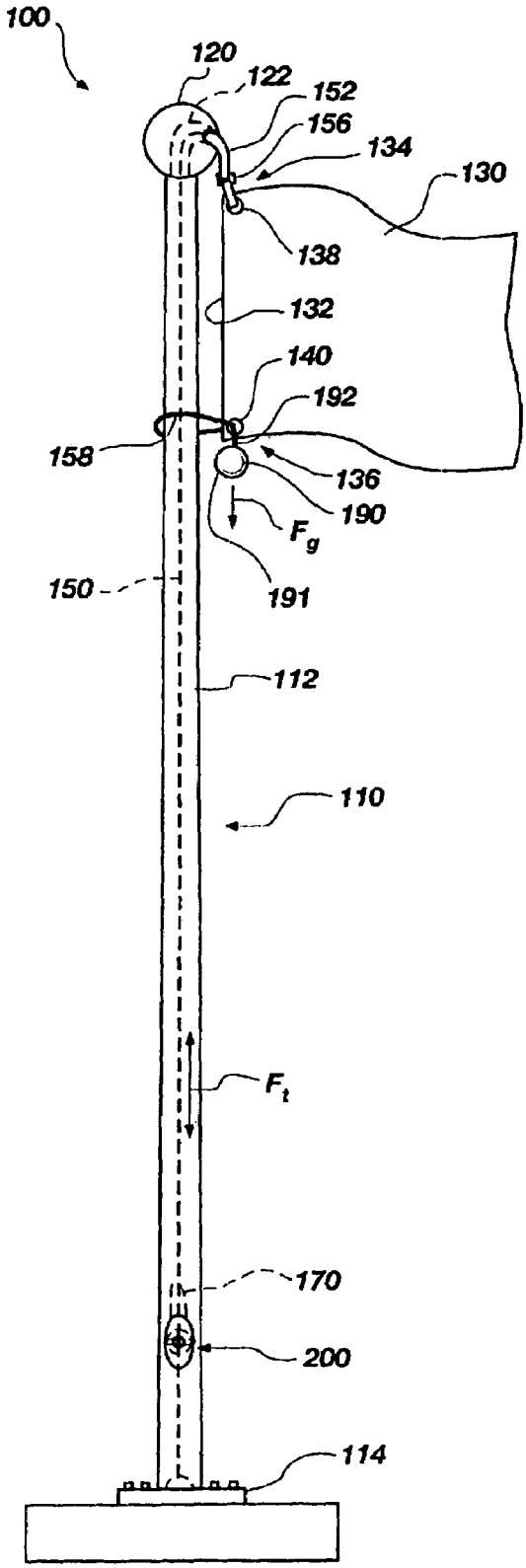
FIG. 1 illustrates a perspective view of a halyard system for coupling a flag to a flag pole, depicting the flag suspended in a raised position with respect to the flag pole, according to an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

FIG. 1 illustrates a halyard system 100 for suspending a flag 130 to a vertically standing flag pole 110. Such a flag 130 is typically rectangular in shape and includes one peripheral side 132 configured to be suspended along side the flag pole 110 to properly display the flag 130. Suspension of the flag 130 along the peripheral side 132 can be employed by including a first eyelet 138 and a second eyelet 140 in the respective upper and lower corner portions 134 and 136 of the peripheral side 132 for coupling to the halyard system 100 to display the flag 130.

In one embodiment, the halyard system 100 of the present invention includes a holding member 170, a line member 150 and a mass structure 190. The holding member 170 can be coupled to a bottom portion of an interior of the flag pole 110. The line member 150 can be operatively coupled to the first eyelet 138 of the flag 130 and extends through an upper portion of the flag pole 110 and is operable to be removably coupled to the holding member 170 within the flag pole 110. The mass structure 190 can be operatively coupled to the second eyelet 140 of the flag 130 and is operable to freely hang from the flag 130. In this manner, the mass structure 190 is operable to place tension on the peripheral side 132 of the flag 130 so as to substantially maintain the peripheral side 132 of the flag 130 in a suspended position along side the flag pole 110. Further, the weight of the mass structure 190 provides a tension force Ft in the line member 150 to facilitate a coupling arrangement with the holding member 170 as well as facilitate lowering the flag 130 down the flag pole 110 after releasing the line member 150 from the holding member 170.

Figure 2:
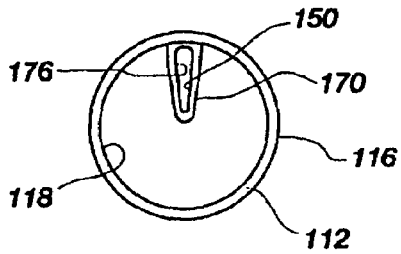
FIG. 2 illustrates top view of a holding member mounted to an inside surface of the flag pole.
Figure 3:
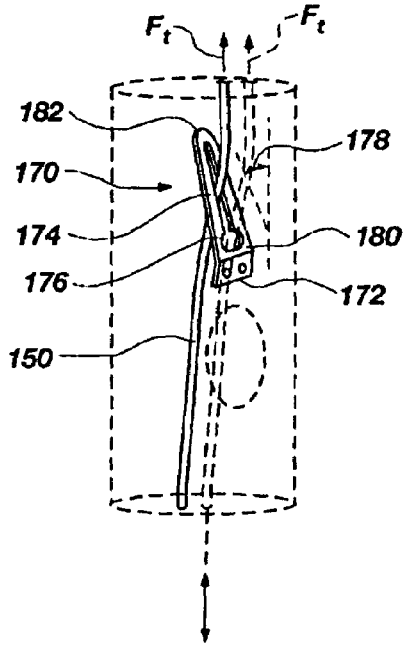
FIG. 3 illustrates a perspective view of the holding member disposed in a lower portion of the flag pole (shown in outline), depicting a line member held within the holding member and the line member displaceable within the holding member for bilinear movement of the line member (shown in outline) within the flag pole.

With respect to FIGS. 1, 2 and 3, the flag pole 110 includes a tube member 112 mountable to a base plate 114. The tube member 112 includes an outer surface 116 and an inner surface 118 with a cap 120 mounted at an upper portion of the tube member 112. The cap 120 can include a spherical shape, cubic shape or any other suitable configuration known in the art. The cap 120 can include a channel 122 defined therein sized and configured to receive the line member 150. Such a channel 122 can include a Teflon coating over the surface defining the channel 122 to limit friction for the line member 150. It is also contemplated that the channel 122 can include rollers mounted therein for limiting friction of the line member 150 extending through the channel 122.

The tube member 112 can also include an access opening 200 sized and configured to access the line member 150 and holding member 170. Such an access opening 200 can be positioned in the tube member 112 at a height suitable for a person to readily access the line member 150 and the holding member 170, such as approximately four feet to five feet above the base plate 114.

The tube member 112 extends a predetermined length, which can be any suitable length in accordance to the desired height of the flag pole 110. In one embodiment, the tube member 112 can include a substantially constant diameter along the longitudinal length of the tube member 112. In another embodiment, the diameter of the tube member 112 can include a slight taper along the longitudinal length from the lower portion to the upper portion of the tube member 112. In addition, the thickness of the tube member 112 can vary, from one tube member to another, depending on the length of the tube member 112 for proper stability and structural integrity as known to one of ordinary skill in the art.

The holding member 170 can be positioned against the inner surface 118 of the tube member 112 and preferably adjacent to and above the access opening 200 or any suitable position within the tube member 112, such as the opposite inner side of the access opening 200, so that a person can readily access the holding member 170. Such a holding member 170 can be a bracket-type structure or any other suitable structure configured to couple the line member 150 thereto. The holding member 170 can be a unitary structure with a first portion 172 and a second portion 174. The first portion 172 is sized and configured to abut against the inner surface 118 of the tube member 112 for fastening thereto with, for example, bolts, screws or any other suitable fastening means, such as welding. The second portion 174 can extend outwardly upward from the inner surface 118 of the tube member 112 at a predetermined angle 178. Such a predetermined angle 178 can be between approximately 25 degrees and 60 degrees from the inner surface 118 of the tube member 112, as indicated in drawing FIG. 3. The second portion 174 of the holding member 170 can also include a wedge-shaped aperture or tapered slot 176 defined therein, which tapered slot 176 comprises a pass-through portion (see circular pass-through portion of tapered slot in FIG. 3)*and* a binding portion (see elongate binding portion of tapered slot in FIG. 3). and which is configured to taper inward from a base end 180 toward a free end 182 of the second portion 174. Such a tapered slot 176, and particularly pass-through portion, is sized and configured to receive the line member 150 therethrough so that the line member 150 is freely moveable through the pass-through portion of the tapered slot 176 at the base end 180, and is further configured to hold or catch the line member 150 within the binding portion with an interference-type fit when the line member 150 is moved toward the free-end 182 of the tapered slot 176. The tapered slot 176 tapers in a manner to facilitate receiving various line members having different sized diameters.

Figure 4:
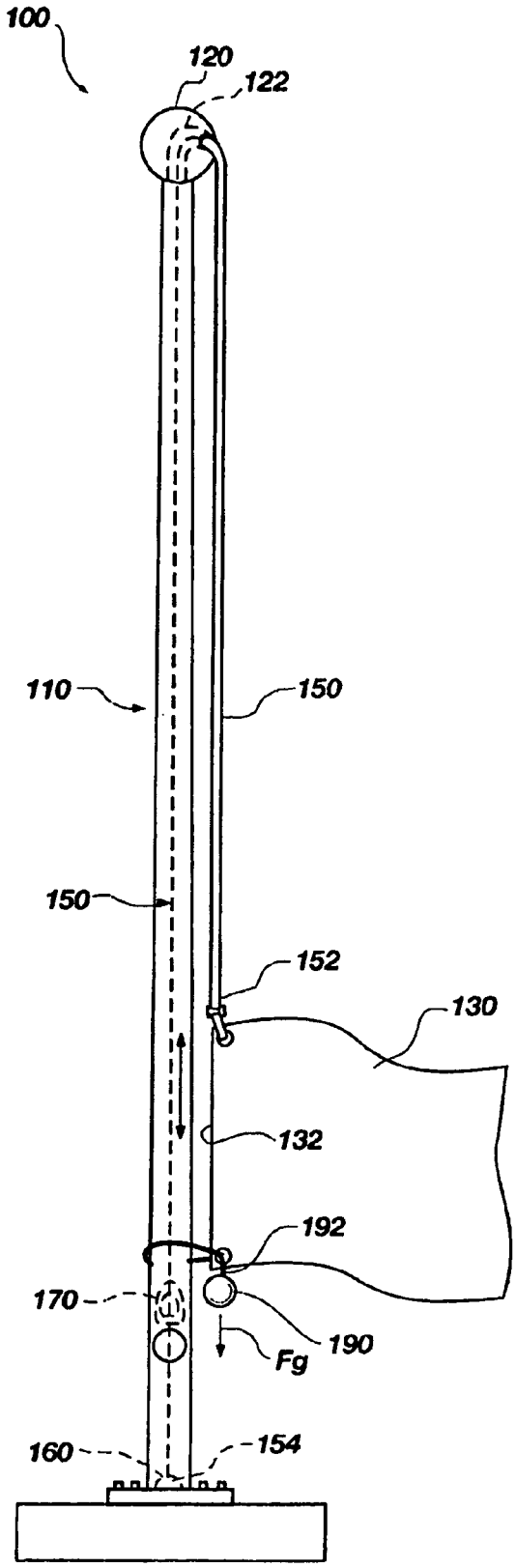
FIG. 4 illustrates a perspective view of the halyard system and the flag pole, depicting the flag in a lowered position with respect to the flag pole.

Referring now to FIGS. 1 and 4, the line member 150 includes a first end portion 152 and a second end portion 154. Such a line member 150 is configured to extend through the longitudinal length of the tube member 112 and can extend through the channel 122 in the cap 120 so that the first end portion 152 of the line member 150 is exposed and operatively coupled to the flag 130. In particular, the first end portion 152 of the line member 150 can be interconnected to a first coupling link 156, which can be removably coupled to the first eyelet 138 in the upper corner portion 134 of the flag 130. The line member 150 can include a length of about twice the length of the flag pole 110 so that when the flag 130 is in the lowered position a person can have any excess line member length necessary to properly remove the flag 130 from the line member 150. Further, the second end portion 154 can include an obstruction member 160 coupled to the line member 150 configured to prevent the line member 150 from passing completely through the tapered slot in the holding member 170 when the flag 130 is in the lowered position. When the flag 130 is in the raised position, the excess portion of the line member 150 can be disposed within and at the lower portion of the tube member 112 below the access opening 200. Such a line member 150 can be made from any suitable material or combination of materials, such as ordinary rope, cord, polymeric rope and blends thereof, and or any other suitable line member known to one of ordinary skill in the art.

The mass structure 190 is operatively coupled to the second eyelet 140 at the lower corner portion 136 of the flag 130 so that the mass structure 190 freely hangs from the flag 130 with a gravitational force Fg applied thereto. Such a mass structure 190 can include a second coupling link 192 so that the mass structure 190 can be readily removed from or coupled to the second eyelet 140 of the flag 130. The mass structure 190 is sized and configured to provide tension in the peripheral side 132 of the flag 130 so that the peripheral side 132 of the flag 130 substantially maintains a suspended position along side the flag pole 110 when in the raised position as well as being suspended when raising or lowering the flag 130. Additionally, to substantially maintain the peripheral side 132 in the suspended position in, for example, climates with high winds, a strap 158 can be included to extend around the flag pole 110 and removably couple to the second eyelet 140 and/or the second coupling link 192 of the mass structure 190.

Further, with respect to FIGS. 1, 3 and 4, when in the fully raised position, and at half mast, the mass structure 190 is sized and configured to provide a tension force Ft in the line member 150. Such tension force Ft in the line member 150 facilitates tightening the coupling between the line member 150 positioned in the tapered slot 176 defined in the holding member 170. Otherwise said, the tension force Ft pulls the line member 150 upward to, thereby, tighten the interference fit within the tapered slot 176. In this manner, the mass structure 190 substantially maintains the peripheral side 132 of the flag 130 in a suspended position as well as facilitates the coupling with the holding member 170.

In addition, the mass structure 190 is a dense, weighted down material with a predetermined weight having a gravitational force Fg applied in the downward direction. The predetermined weight is such that, when the flag 130 is in the raised position, a person can manually release the interference fit between the line member 150 and the holding member 170 so that the weight of the flag 130 combined with the predetermined weight of the mass structure 190 naturally pulls the line member 150 upward within the tube member 112 to, thereby, lower the flag 130. Such weighted down material of the mass structure 190 can be any suitable material, such as a metal, lead, and/or a dense polymeric-type material or combinations thereof. The mass structure 190 can be shaped in the form of a ball, cylinder, cone or any suitable shape desired. The mass structure 190 can include a weight between approximately 3 lbs. to 30 lbs. However, such weight may vary depending on the weight of the line member 150, the weight of the flag 130 and the friction produced between the line member 150 and the channel 122 in the cap 120 of the flag pole 110. As such, the weight of the mass structure 190 can be readily determined by one of ordinary skill in the art knowing the above-noted weights and approximate friction produced in the channel 122 in the flag pole 110. A damping surface 191 of foam rubber or other sound reducing material can be applied to minimize sound of the weight impacting the pole.

Figure 5:
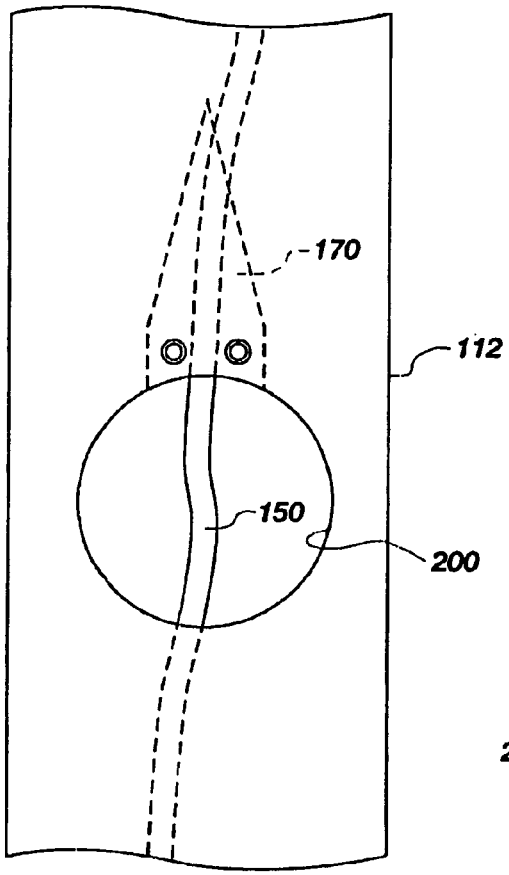
FIG. 5 illustrates a partial front view of the flag pole, depicting an access opening for gaining access to the line member and the holding member.
Figure 6:
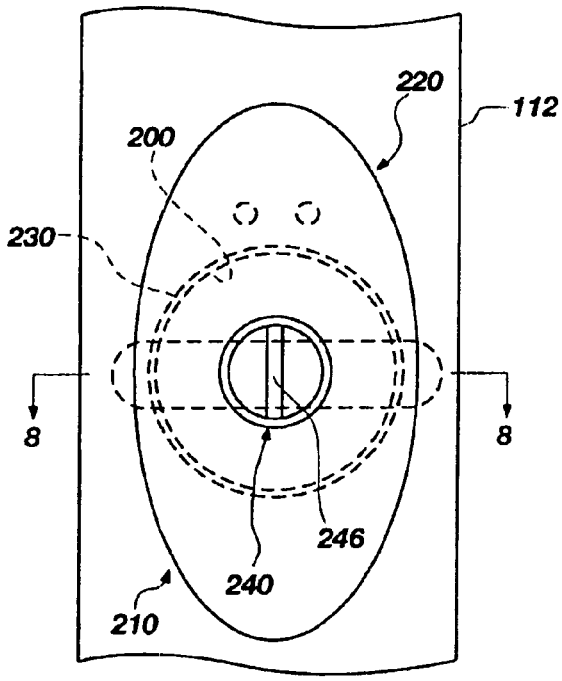
FIG. 6 illustrates a partial front view of the flag pole, depicting a door member enclosing the access opening in a locked position, according to another embodiment of the present invention.

Turning now to FIGS. 5 and 6, in another embodiment of the halyard system, the access opening 200 is configured to receive a door member 210. As previously described, the access opening 200 is an opening defined through a surface of the tube member 112 and is sized and configured to facilitate access to the line member 150 and holding member 170. The door member 210 is configured to enclose the access opening 200 in a locking arrangement to prevent unauthorized access to the line member 150 as well as allow ready access to the line member 150 to those that are authorized.

Figure 7:
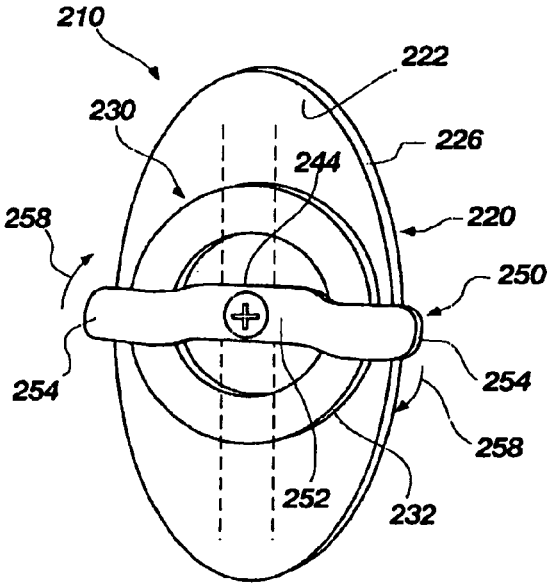
FIG. 7 illustrates a perspective rear view of the door member having a locking extension member disposed thereon, depicting the locking extension member rotatable to a locked position and an open position (shown in outline)
Figure 8:
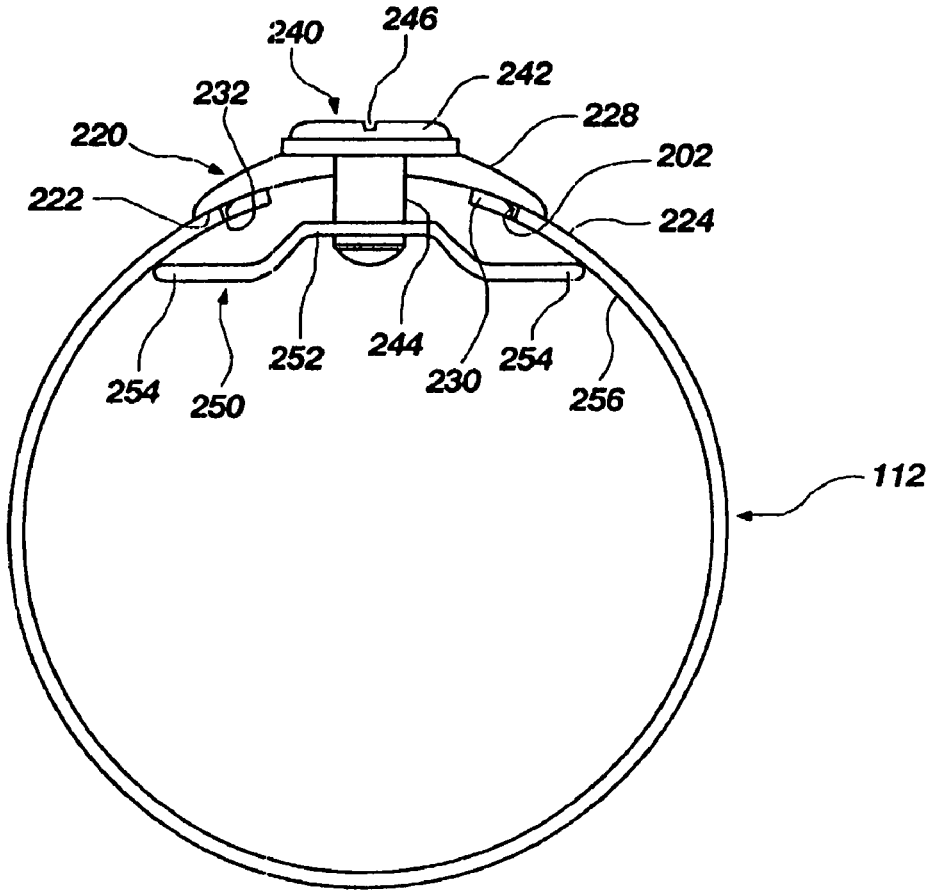
FIG. 8 illustrates a cross-sectional view taken along line 8 in FIG. 6 of the door member in a locked position in the access opening of the tube member.

Referring to FIGS. 6, 7 and 8, the door member 210 includes a front plate 220, a rear plate 230, a lock housing 240 and a locking extension member 250. The front plate 220 can be oval in shape, or any other suitable shaped configuration, with a back surface 222 contoured with a radius of curvature to sit flush with an outer surface 224 of the tube member 112. In addition, the front plate 220 is sized to cover the access opening 200 and the exposed fasteners used to fasten the holding member 170 to the tube member 112.

The rear plate 230 can be joined to the back surface 222 of the front plate 220 with an outer periphery 232 smaller than an outer periphery 226 of the front plate 220. The rear plate 230 can be contoured to coincide with the contoured back surface 222 of the front plate 220 and can include a ring configuration symmetrically centered on the back surface 222 of the front plate 220. The outer periphery 232 of the rear plate 230 is sized and configured to fit snug within an edge 202 defining the access opening 200. With this arrangement, the door member 210 can be readily fitted with the access opening 200 by simply positioning the rear plate 230 within the access opening 200 and adjusting the orientation until the contoured back surface 222 of the front plate 220 sits flush against the outer surface 224 of the tube member 112.

The lock housing 240 includes a front portion 242 and a rear portion 244 and extends through the front plate 220. The front portion 242 can sit flush with or protrude from a face surface 228 of the front plate 220. The front portion 242 includes a key hole 246 defined therein configured to receive a key (not shown). The rear portion 244 protrudes from the back surface 222 of the front plate 220 and is operatively coupled to a locking extension member 250.

The locking extension member 250 can include a middle portion 252 with opposite end portions 254 in a wing-type configuration. The middle portion 252 can be coupled to the rear portion 244 of the lock housing 240. Such a locking extension member 250 can be placed in an open position with the opposite end portions 254 extending vertically (shown in outline) and a locked position with the opposite end portions 254 positioned horizontally. The locking extension member 250 can be rotated to such positions by inserting the key in the key hole 246 and turning the key to either the open or locked positions as known to one of ordinary skill in the art. The locking extension member 250 can provide the locked position with the opposite end portions 254 sized and configured to abut with an inner surface 256 of the tube member 112. Locking the door member 210 is employed by rotating the locking extension member 250 from the open position to the locked position so that the end portions 254 rotatably slide against the radial curvature of the inner surface 256 of the tube member to provide an interference type fit. Likewise, rotating the locking extension member 250 to the open position, as indicated by arrows 258, provides clearance for the end portions 254 with respect to the inner surface 256 of the tube member 112 to, thereby, allow the door member 210 to be manually removed to expose the access opening 200 and allow access to the line member 150 and holding member 170 (FIG. 5).

Figure 9:
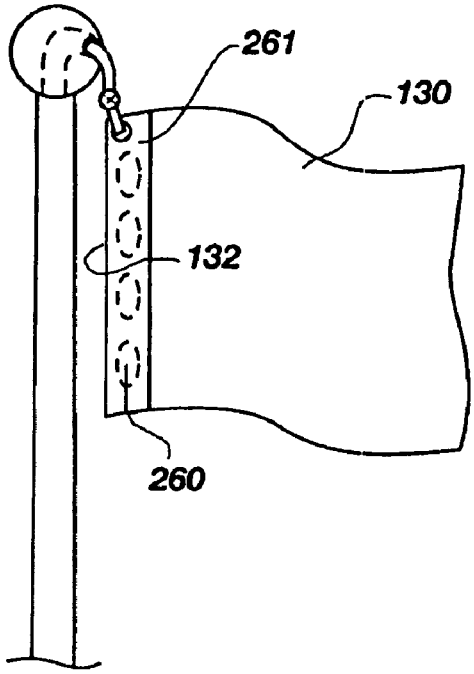
FIG. 9 illustrates a front view of a weighted mass structure retained in a hem of a peripheral side of the flag.

Referring to FIG. 9, in one embodiment the halyard system 100 of the present invention includes a weighted mass structure 260, or a plurality thereof, retained in a hem 261 of the peripheral side of the flag 132.

Figure 10:
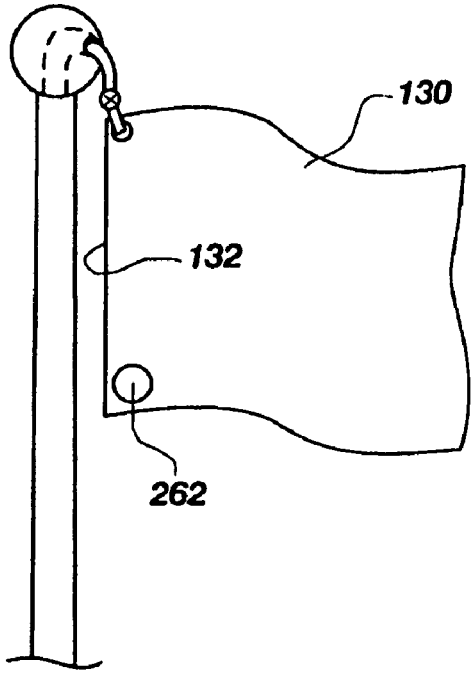
FIG. 10 illustrates a front view of a weighted mass structure coupled to a peripheral side of the flag wherein the weighted mass structure comprises first and second magnetic structures configured for placement on opposing sides of the flag.
Figure 10A:
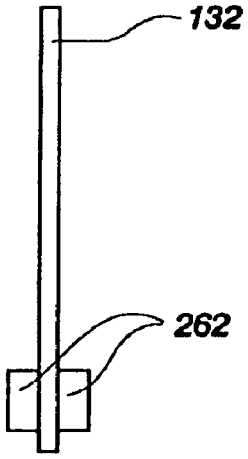
FIG. 10A illustrates a perspective view of a weighted mass structure coupled to a peripheral side of the flag wherein the weighted mass structure comprises first and second magnetic structures configured for placement on opposing sides of the flag.

Referring to FIGS. 10 and 10A, in one embodiment the halyard system 100 of the present invention includes a weighted mass structure 262, or a plurality thereof, coupled to the peripheral side of the flag 132 wherein the weighted mass structure 262 comprises first and second magnetic structures configured for placement on opposing sides of the flag 130.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

The invention claimed is:

1. A locking door for an access opening in a flag pole configured to access a halyard system disposed internally in the flag pole, the locking door comprising:

a front door plate having a face surface and a back surface, the back surface having a radius of curvature configured to sit flush against an outer surface of the flag pole;

a rear door plate coupled to the back surface of the front door plate, the rear door plate having an outer periphery sized to be disposed within the access opening;

a lock housing having a front portion and a rear portion, the front portion exposed on the face surface of the front plate and having a key hole defined therein, the back portion protruding from the back surface of the front door plate; and a locking extension member having a middle portion coupled to the rear portion of the lock housing and opposite free end portions extending from the middle portion, the locking extension member being operable to selectively lock and unlock the locking door.

2. The locking door of claim 1, wherein the front door plate is sized to cover the access opening and the exposed fasteners used to fasten the holding member to the tube member within the flagpole.

3. The locking door of claim 1, wherein the rear door plate is contoured to coincide with the contoured back surface of the front plate.

4. The locking door of claim 1, wherein the locking extension member can be rotated to a locked position by inserting a key into the keyhole located on the outer surface of the locking door and positioning the locking extension member so the free ends are disposed horizontally against the inner surface of the flag pole with an interference fit.

5. The locking door of claim 1, wherein the locking extension member can be rotated to an unlocked position by inserting a key into the keyhole located on the outer surface of the locking door and positioning the locking extension member so the free ends are disposed vertically preventing interference with the inner surface of the flag pole.

6. A halyard system for suspending a flag on a flagpole, the halyard system comprising:

a flagpole;

a line member configured to extend and selectively advance about said flagpole to support a flag in one of several positions on said flagpole;

a holding member configured to retain said line member, said holding member having a first portion coupled to a wall of said flagpole, and a second portion configured to extend outwardly with respect to said wall of said flagpole, said second portion having a wedge-shaped aperture formed therein that comprises a pass-through portion configured to receive said line member and to permit passage therethrough, and a binding portion configured to removably bind said line member and to prevent the advancement thereof through said holding member using a force-fit, and said wedge-shaped aperture being operatively orientated to urge said line member into said binding portion.

7. The halyard system of claim 6, wherein said wedge-shaped aperture comprises opposing structural members configured to taper and converge as said second portion extends from said wall of said flagpole to provide said binding portion, said wedge-shaped aperture providing variable binding portions depending upon a size of said line member.

8. The halyard system of claim 7, wherein said second portion of said holding member comprises an inclined configuration with respect to said wall, such that said second portion extends outward and upward from said first portion and said wall to urge said line member into said binding portion of said wedge-shaped aperture, and to increase said force-fit.

9. The halyard system of claim 8, wherein said inclined configuration is configured to automatically cause said line member to be drawn into said binding portion in the event said line member is inadvertently caused to advance without user assistance.

10. The halyard system of claim 6, wherein said holding member is configured to provide selective repositioning of said line member by releasing said line member from said binding portion, advancing said line member through said pass-through portion of said aperture a desired distance, and again causing said line member to be drawn into said binding portion.

11. The halyard system of claim 6, wherein said flagpole comprises a tubular configuration defining outer and inner walls.

12. The halyard system of claim 11, wherein said holding member is coupled to said inner wall of said flagpole.

13. The halyard system of claim 12, wherein said flagpole comprises an opening formed therein to access said holding member as coupled to said inner wall.

14. The halyard system of claim 13, further comprising a locking door operable with said opening to selectively control access to said holding member.

15. The halyard system of claim 6, further comprising a weighted mass coupled to said flag to increase the tautness in said line member and a force acting within said line member having a tendency to advance said line member about said flagpole under gravity.

16. The halyard system of claim 15, wherein said weighted mass structure is coupled at a location selected from the group consisting of a midsection of a peripheral side of the flag, an intersection of said peripheral side and a lower side of said flag, an intersection of said peripheral side and an upper side of said flag, and within a hem of said peripheral side of said flag.

17. The halyard system of claim 15, wherein said weighted mass structure comprises first and second magnetic structures configured for placement on opposing sides of said flag.

18. The halyard system of claim 6, further comprising a plurality of weighted mass structures.

19. The halyard system of claim 6, wherein said line member has a positionable obstruction member coupled near a terminal end to prevent said line member from passing completely through said aperture of the holding member.

20. The halyard system of claim 6, wherein said holding member comprises a unitary structure.

21. A halyard system for suspending a flag on a flagpole, the halyard system comprising:

a flagpole comprising a tubular configuration having an inner wall;

a line member configured to extend and selectively advance through said flagpole to support a flag in one of several positions about said flagpole; and a holding member configured to retain said line member, said holding member having a first portion coupled to said inner wall of said flagpole, and a second portion configured to extend outwardly with respect to said inner wall, said second portion having an aperture formed therein that comprises a pass-through portion configured to receive said line member and to permit passage therethrough, said aperture also comprising a binding portion configured to bind said line member and to prevent the advance thereof through said holding member using a force-fit, said aperture being operatively orientated to urge said line member into said binding portion.

22. A method for suspending a flag on a flagpole, said method comprising:

obtaining a flagpole having a tube configuration and that is operable with a line member to support a flag on said flagpole, said flagpole comprising a holding member secured to an inner wall thereof and having an aperture formed therein, said aperture being operatively orientated to urge said line member into a binding portion of said aperture; and causing said line member to be drawn into said binding portion of said aperture, said binding portion being configured to bind said line member using a force-fit to prevent the advance of said line member through said aperture and said holding member, and to therefore retain said line member and said flag in a desired position.

23. The method of claim 22, further comprising releasing said line member from said binding portion to advance said line member through said holding member.

24. The method of claim 23, further comprising:

advancing said line member through said aperture a desired distance to reposition said line member; and causing said line member to again be drawn into said binding portion.

* * * * *